United States Patent [19]

Halaby et al.

[11] 4,211,006

[45] Jul. 8, 1980

[54] GUARDED RAZOR BLADE

[75] Inventors: Sami A. Halaby, Trumbull; Edward S. Caco, Danbury, both of Conn.

[73] Assignee: Warner-Lambert Company, Morris Plains, N.J.

[21] Appl. No.: 411

[22] Filed: Jan. 2, 1979

[51] Int. Cl.[2] ..... B26B 21/54

[52] U.S. Cl. ..... 30/346.55; 427/275; 427/272; 427/282; 430/320; 204/15; 430/323; 430/324

[58] Field of Search ..... 30/78, 346.54, 346.55, 30/346.56, 346.58, 346.59, 346.60, 346.61; 427/275; 204/15; 96/36; 156/659

[56] References Cited

U.S. PATENT DOCUMENTS

| | | | |
|---|---|---|---|
| 1,035,548 | 8/1912 | Dickenson | 30/78 |
| 1,846,622 | 2/1932 | Thompson | 30/346.58 |
| 3,263,330 | 8/1966 | Ferrava | 30/346.56 |
| 3,505,734 | 4/1970 | Iten | 30/346.58 |
| 3,555,682 | 1/1971 | Laszlo | 30/346.56 |
| 3,675,325 | 7/1972 | Michelson | 30/346.58 |
| 3,750,285 | 8/1973 | Michelson | 30/78 |
| 4,094,066 | 6/1978 | Daniel | 30/346.58 |

FOREIGN PATENT DOCUMENTS

| | | | |
|---|---|---|---|
| 2712790 | 9/1977 | Fed. Rep. of Germany | 30/346.55 |

*Primary Examiner*—Ralph S. Kendall

*Attorney, Agent, or Firm*—Jeremiah J. Duggan; Stephen A. Schneeberger

[57] ABSTRACT

A razor blade having guard elements deposited in recessed guard seats formed in the cutting edge and flanking surfaces of the blade. The guard elements may be deposited by electrochemical plating and their retention on the blade is enhanced by the recessed seats formed in the blade surfaces. The guard seats extend rearwardly from the blade edge a significant distance and may be interconnected by a transversely extending locking guard seat into which guard element material is also deposited.

A method for applying the guard elements to the blade comprises applying a photoresist material to the blade edge and adjacent region, fixing a photographic image on the photoresist material in accordance with a predetermined guard element pattern, removing a portion of the photoresist material in accordance with the pattern and etching the underlying blade to form the guard seats. Thereafter the guard elements are deposited in the guard seats as by electroplating and the remaining photoresist material is removed to expose the blade edge and guard elements.

15 Claims, 11 Drawing Figures

GUARDED RAZOR BLADE

BACKGROUND OF THE INVENTION

The present invention relates to improvements to guarded razor blades for shaving. For as long as a man has attempted the removal of hair from the body, energy has been directed to ameliorating the effects of the sharpened cutting edge on the skin of the user. Despite all efforts, occasional skin irritation and blood-letting still occur during the shaving process.

This invention relates more particularly to razor blades having guard elements deposited thereon in retaining seats formed in the edge and flanking sides of the blade.

Numerous methods have been devised to minimize the nicking or cutting of the skin which may occur during shaving, a large portion directed to improved forms of edge guards. A patent to Dickinson, U.S. Pat. No. 1,035,548, issued Aug. 13, 1912, discloses a straight razor having a long blade on which is spirally wound a wire or thread to form a guard. Another form of guard is disclosed by Ferrara in U.S. Pat. No. 3,263,330 issued Aug. 2, 1966, wherein the razor blade cutting edge is encapsulated in a folded sheet of metal having a row of holes through which the hairs but not the skin pass for cutting.

A more recent development is disclosed in U.S. Pat. No. 3,505,734 issued to Iten on Apr. 14, 1970, for a cutting blade with self-contained guard. In this patent, a razor blade with a self-contained guard in the form of a wire is described. The wire or thread of selected diameter is wound about the body of the blade encompassing its ultimate edge. The spacing or pitch between successive turns of the wire is controlled relative to its diameter to provide protection to the skin of the user and diminished probability of cutting or nicking. The selected critical thread diameter and spacing between successive thread portions at the cutting edge of the blade may be drawn across the skin without coming in contact therewith. Some positional stability is given to the wound wire guard elements by spot-welding them to the blade at a location back from its edge and by passing the wire through notches in the blade edge.

Another arrangement similar to that of Iten is disclosed in U.S. Pat. No. 3,750,285 to Michelson issued on Aug. 7, 1973. There the razor blade has a guarded cutting edge comprising a multiplicity of relatively short and thin guard members bent into relatively V-shaped form and secured to the blade edge by permanent attachment of the respective ends of each guard member to the razor blade base structure at points relatively close to the blade cutting edge. Those guard elements as well may be seated in notches formed in the blade edge or, if relatively softer than the blade edge, may have the blade edge embedded therein.

While the self-contained guards of Iten and Michelson may be successful in insulating the skin from the ultimate cutting edge of the razor blade, they do introduce numerous and severe problems into the manufacturing of razor blades incorporating its principal features. The thread or threads must be of flexible material having precise dimensional conformity. It must also be sufficiently flexible for winding about the body of the blade or at least over the blade edge and yet strong enough to withstand severing as it passes over and comes into contact with the blade edge. Moreover, once the wire is placed on the blade, it must be adhesively or otherwise locked into position to prevent interference with shaving and to maintain its advantageous characteristics. With regard to this latter fact, it must be kept in mind that as the wire comes into contact with the ultimate edge of the blade, the edge being 300 to 500 Angstroms in radius, it necessarily damages the blade edge making such contact portion substantially incapable of providing comfortable shaving characteristics. Such method of applying guard elements to the blade edge also inherently increases blade damage, resulting in a less efficient manufacturing operation.

More recently, techniques have been disclosed in U.S. patent applications No. 645,055 filed Dec. 29, 1975, by Beddall for Printed Blade Shield, and No. 911,026 filed May 31, 1978, by Auton for Blade Shields and being a continuation of Ser. No. 778,755 filed Mar. 17, 1977, now abandoned all being assigned to the same assignee as the present invention, for placing guard or shielding elements on a blade edge without many of the shortcomings of the aforementioned prior art techniques. Specifically, epoxy resins may be placed on the edge and flanking facets of a blade using ink jet printing techniques or, alternatively, the guard elements may be deposited by sputtering or ion plating. These techniques overcome some of the objections of the aforementioned prior art techniques. However, the guard elements so deposited may be subject to dislodgement from the blade in response to normal shaving forces and/or abuse.

It is an object of the preferred form of the invention to provide an improved method for applying structural elements to a cutting or razor blade. It is another object of the present invention to provide a razor blade product having structural elements thereon. Another object of the present invention is to provide a razor blade having a deposited guard formed thereon. Yet another object of the present invention is to provide for the placement of guard elements on a razor blade in a manner enhancing their retention on the blade.

SUMMARY OF THE INVENTION

In overcoming the problems of the prior art and in achieving the objects as heretofore set forth, the present invention contemplates a razor blade having structural guard elements deposited thereon in a manner such that their retention on the blade is enhanced. In one embodiment, these elements extend beyond the ultimate edge of the blade thereby providing a guard for preventing nicking and cutting of the user's skin.

According to a preferred aspect of the present invention, the guard elements are deposited in recessed guard seats formed in the blade edge and in the adjacent flanking surfaces extending rearwardly therefrom. The material of which the guard elements are formed is additionally deposited in a locking guard seat recessed into the blade and extending parallel to the blade edge and interconnecting the several guard seats and elements.

Another aspect of the invention provides a method for depositing guard elements in guard seats on a razor blade. In accordance with this method, the blade edge and flanking surfaces are covered with a protective material, portions of the protective material are removed in accordance with the predetermined pattern of the guard elements to be deposited, the exposed metal of the blade is then etched to create guard seats in accordance with the pattern, a guard-forming material is then deposited on the exposed portions of the blade, as by electroplating, and the blade-protecting material is finally removed to expose the ultimate blade edge with the deposited guard elements retained securely thereon.

DESCRIPTION OF THE PREFERRED EMBODIMENT

Figure 1:
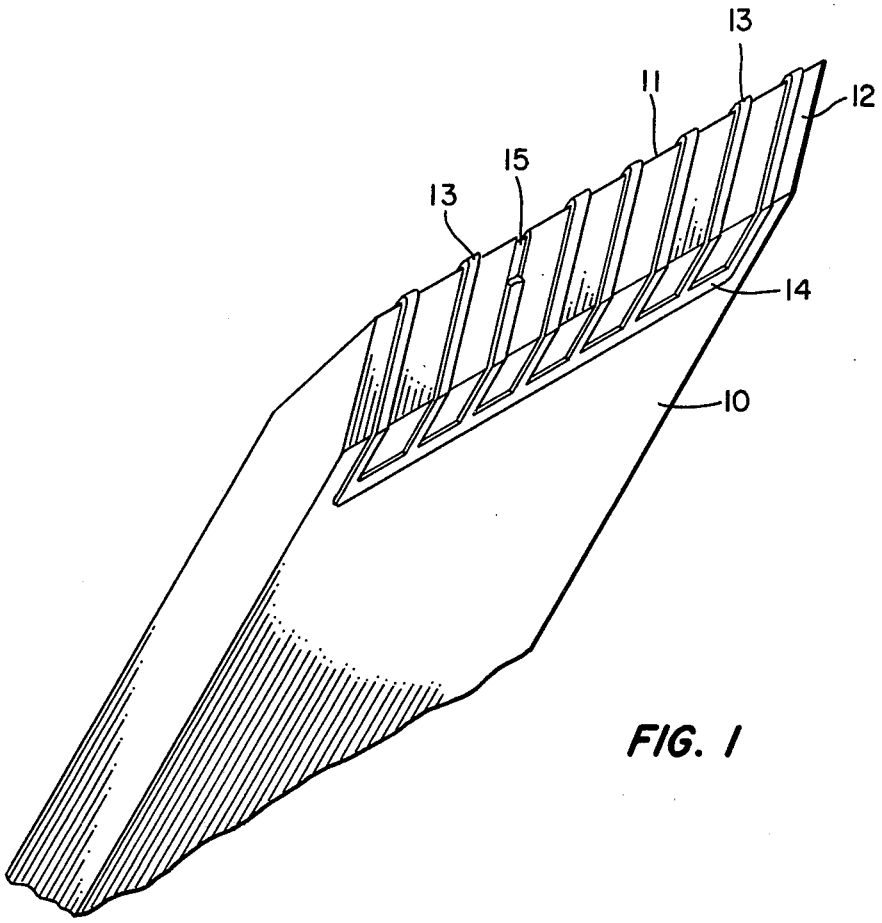
FIG. 1 is a diagrammatic perspective view of a razor blade having deposited guard elements formed in guard seats thereon.

Referring to FIG. 1, razor blade 10 is shown having an ultimate shaving edge 11 formed by at least two intersecting and flanking facets or surfaces 12. Arranged transversely to the ultimate edge are deposited guard elements 13 passing over edge 11 and extending rearwardly therefrom in the flanking surfaces 12 toward, and in this embodiment into, the body of the blade 10. Deposited elements 13 are respectively spaced along and throughout the longitudinal axis of blade 10. Locking guard elements 14 extending parallel to the blade edge 11 and transversely of the guard elements 13 interconnect the respective guard elements at their rearward extremes to enhance the integrity and permanence of the guarding structure as will be hereinafter evident. Not shown in FIG. 1 is an organic polymer coating placed over the entire edge structure in order to facilitate haircutting and shaving comfort.

One of the guard elements 13 of FIG. 1 has been broken and removed to show an important aspect of the invention, that being the recessed guard seats 15 which act to securely retain guard elements 13 on blade 10. Guard seats 15 are coextensive with the guard elements 13 and similar locking guard seats 15' underlie and are coextensive with the respective locking guard elements 14 on opposite sides of blade 10.

Figure 2:
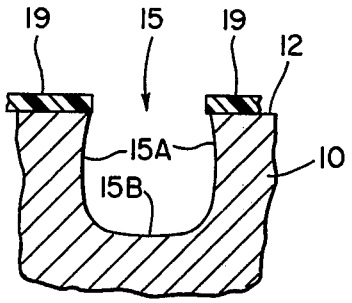
FIG. 2 is a partial sectional view of a razor blade taken transversely of the length of a guard seat.
Figure 3:
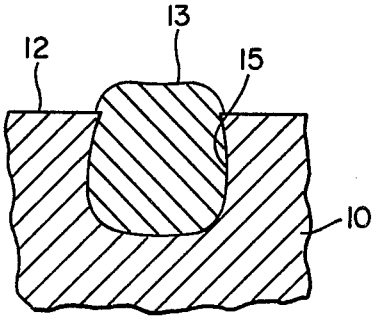
FIG. 3 is a partial sectional view of a razor blade taken transversely of the length of a guard seat and showing a guard element formed therewith.
Figure 4:
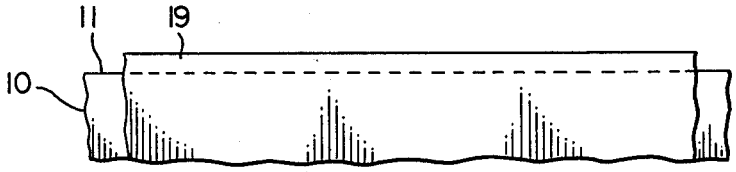
FIG. 4 is a diagrammatic presentation of a partial side profile view of a razor blade showing a photoresist covering.

FIG. 2 comprises a sectional view of a guard element seat taken transversely of the length of the guard seat. The depth of seat 15 below the flanking surface 12 need not be great and may typically be about 0.0005 inch. Further, in accordance with a preferred embodiment and method of practicing the invention, the opposed side walls 15A of a guard seat 15 may be slightly divergent in the downward direction such that the seat base 15B may be slightly wider than its mouth which lies in the plane of flanking surface 12. In this way, a guard seat 15 may more securely and permanently retain a guard element 13 as illustrated in FIG. 3. It will be further understood that although seat side walls 15A are illustrated in FIG. 2 as singular planar surfaces, they may indeed be curvilinear or multifaceted, but, in any event, serve to resist displacement of guard elements 13 seated therein due to lateral forces. It will be appreciated that the recessed guard seats 15 provide a substantially increased surface area to which the guard elements 13 may adhere as well as providing surfaces oriented to resist dislodgement of the guard elements by shaving and other forces. Guard elements 13 may be any of a variety of materials which may be controllably deposited in guard seats 15 to a desired thickness and possessing a sufficient degree of durability to retain their desired functional characteristics over the shaving life of blade edge 11. A preferred group of materials for the guard elements 13 would include those which may be electrochemically deposited as will be hereinafter described.

The width of each guard element 13 is typically about 0.0055 inch although it will be appreciated that other widths may be equally as satisfactory, such widths typically being within the range of about 0.002 to 0.010 inch. Moreover, the distance between the guard elements in this embodiment is about 0.025 inch, though such spacing may be within the range of 0.003 to 0.080 inch. The height of guard elements 13 above the flanking surfaces 12 may be about 0.0005 inch at edge 11 and may increase to 0.003 inch at and beyond about 0.15 inch rearwardly of the edge. Of course, this dimension at edge 11 may also be varied within the range of about 0.000 to 0.0015 inch to allow engagement of edge 11 with the hairs to be cut yet sufficiently prevent entry of the skin therebetween to avoid nicking.

Figure 8:
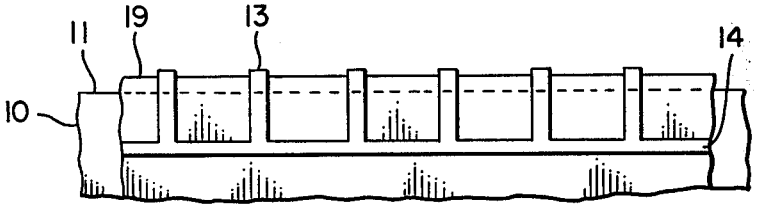
FIG. 8 is a diagrammatic presentation of a partial side profile view of a razor blade showing guard elements deposited in the guard seats.
Figure 9:
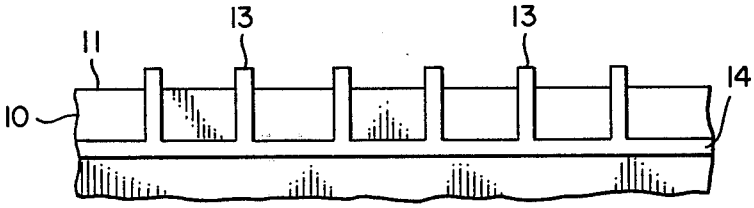
FIG. 9 is a diagrammatic presentation of a partial side profile view of a razor blade showing the photoresist material completely removed to expose the blade edge and guard elements.
Figure 10:
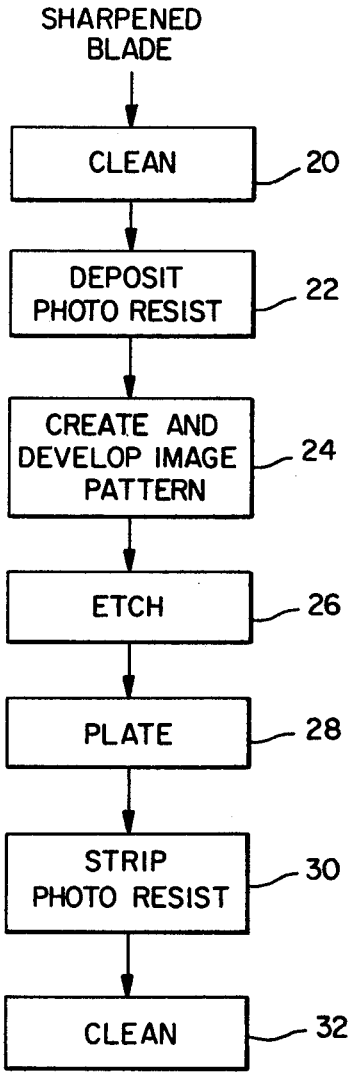
FIG. 10 is a functional block diagram representing the method of forming guard seats and guard elements on a razor blade.

The guard seats and their corresponding blade elements 13 are provided in accordance with the process diagrammatically depicted in the block diagram of FIG. 10, the blade as it appears at intermediate stages in the process being depicted in FIGS. 4 through 9. More specifically, a sharpened blade 10 is subjected to a first cleaning operation 20 comprising degreasing in trichlorethylene vapor, dipping in hot alkali, rinsing, acid dipping in 10% aqueous sulphuric acid, rinsing in deionized water, dipping in methol alcohol, and drying.

Next, a suitable photoresist material 19 is deposited on at least blade edge 11 and flanking surfaces 12 and preferably the entire blade as indicated at block 22. The photoresist material may be of either the positive or the negative variety and may be applied to the blade in a variety of manners, including spinning, spraying, laminating, etc. In a preferred embodiment, the blade 10 is laminated between two sheets or layers of photoresist of the negative variety, that photoresist being DuPont 210R.

Following the application of photoresist material to blade 10, a pattern in accordance with the intended guard element patterning is fixed in the photoresist. More specifically, a mask in the form of the guard pattern is positioned closely adjacent the opposite flanking surface 12 and the body of the blade immediately rearward thereof and a light source of the appropriate wavelength is trained on each mask such that the light is transmitted through the optically transparent portions thereof onto the upper body, flanking surfaces, and edge of the blade. The light acts to polymerize and fix this particular photoresist material, thus the areas of the blade to receive the guard seats are masked from the light such that a print-out image thereof appears on the blade. It will be appreciated that with a positive type photoresist material only those areas exposed to light may be subsequently removed and thus will comprise the guard seat areas.

Figure 5:
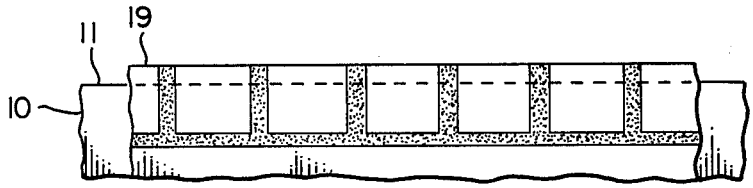
FIG. 5 is a diagrammatic presentation of a partial side profile view of a razor blade showing the guard seat pattern developed in the photoresist.

In FIG. 5, those portions of the hatched photoresist material which comprise the patterning of the guard seats are shown as being crosshatched.

Figure 6:
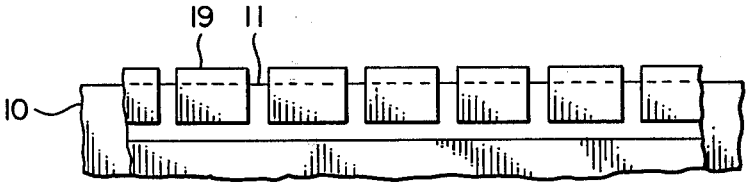
FIG. 6 is a diagrammatic presentation of a partial side profile view of a razor blade showing the photoresist partially removed.

In the process of creating and developing the guard pattern, designated by block 24 in FIG. 10, there is also included the step of removing the nonfixed portions of the photoresist material in the pattern of the guard seats. The blade 10 with the now-exposed photoresist material 19 is placed in a known type of aqueous solution which removes the nonpolymerized portions of the photoresist material. In the present embodiment, this solution comprised DuPont D2000. The blades are then rinsed in water at room temperature and subsequently baked, resulting in the blade edge 11 and flanking facets 12 being exposed in the pattern of the guard seats, as illustrated in FIG. 6.

Figure 7:
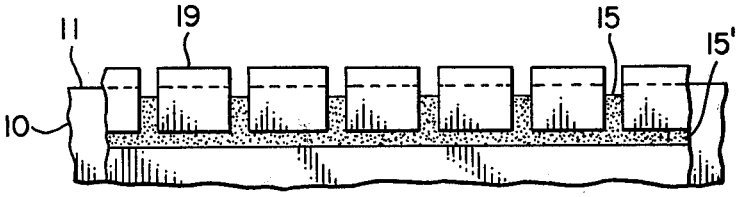
FIG. 7 is a diagrammatic presentation of a partial side profile view of a razor blade showing the blade etched to create guard seats.

Next, as illustrated by block 26 in FIG. 10, the blade 10 is etched with ferric chloride or other suitable etchant to remove steel in a controlled fashion to provide the guard seats 15 illustrated in FIG. 7. The period for which the blade 10 is exposed to the ferric chloride etchant is dependent upon its concentration and the desired depth of the guard seats 15, 15'. It will be understood that the seat depth may be greatest at edge 11 where material is removed from both sides. Typically that time will range between ten and 120 seconds. In addition to creating the recessed guard seats 15, 15', the chemical etch also roughens the surface of those guard seats to further promote adhesion of the guard elements thereto. As earlier noted in the discussion of FIG. 2, the base 15B of guard seat 15 may be somewhat wider than its mouth located in the plane of photoresist coating 19. This undercutting of the blade beneath photoresist 19 and the edge 11 may occur as a result of turbulence in the etchant which enables it to more vigorously attack and erode blade material at small distances somewhat removed from the sheltering covering of photoresist 19. The etchant is subsequently removed from the blade by rinsing in deionized water.

Further in accordance with the invention, guard elements and locking guard elements 13 and 14 respectively are deposited in the guard seats 15, 15' respectively as by the plating operation 28 of FIG. 10. While the guard elements 15, 15' might be deposited in their respective guard seats in accordance with certain of the guard element depositing techniques disclosed in the prior art, the preferred process herein comprises an electrochemical plating operation. Then at least the blade edge 11 and exposed guard seats 15, 15' are immersed in a suitable electrolyte in the presence of a nickel anode. An electropotential is established between blade 10 and the nickel anode such that the nickel is caused to plate on the blade in the exposed guard seats 15, 15'. This plating is continued until guard elements 13 and 14 have a predetermined thickness. By varying current density and/or time, it is possible to control the depth or thickness of the guard elements at edge 11. FIG. 8 illustrates blade 10 with the guard elements 13, 14 plated thereon and the photoresist 19 still in place.

The photoresist layer 19 is then stripped from the blade 10 as represented by box 30 in FIG. 10. This is accomplished using a stripper such as DuPont S1000X or S1100X followed by Shipley 1112A in an ultrasonic bath. A rinse removes the residue, leaving the blade as illustrated in FIG. 9 with the cutting edge 11 again exposed and the guard elements 14 and locking guard 15 disposed thereon. A final cleaning step, represented by box 32 in FIG. 10, comprises bathing blade 10 in water, then methol alcohol, and subsequently drying it.

Figure 11:
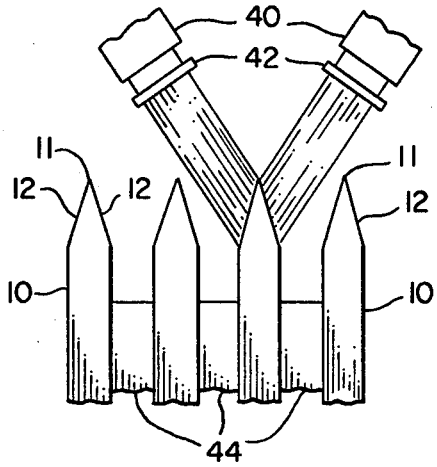
FIG. 11 is a diagrammatic side view of a stack of razor blades illustrating the application of the guard element pattern to the blade edges.

Although the foregoing method was described in the context of a single blade 10, it will be appreciated by reference to FIG. 11 that the process is generally applicable to a large number or batch of blades arranged in a column as in a processing magazine. The magazine may be moved relative to one or a pair of light sources 40 so as to project light through pattern masks 42 onto the photoresist material (not shown here) on the edges 11 and flanking surfaces 12 of successive blades 10. Normally a pattern mask 42 will extend the full width of a blade surface 12, and if the light beam from a source 40 is relatively small it may be necessary to array a series of light soruces across the width of a blade or to move a single light source laterally relative to mask 42 and the blade 10. The embodiment illustrated in FIG. 11 employs the technique of projection masking in which masks 42 are spaced from the surfaces 12 upon which the images are to be formed. For such technique, the light from sources 40 is preferably collimated. Because of the relatively narrow angle defined by intersecting surfaces 12 of a blade 10 and the need to project an image of the locking guard seat 15' onto a flanking surface some 0.020–0.060 inch rearwardly of cutting edge 11, spacer elements 44 are shown disposed between successive blades 10 such that the light source 40 and mask 42 spaced from surface 12 may project the desired image on the blade surface without interference from an adjoining blade. Further, because of the limited optical clearance between the light source 40 and the body of blade 10 rearward of flanking surfaces 12, it may be preferable to restrict the length of guards 13 and seats 15.

The razor blades with edge guards formed in guard seats in the razor blade provide an opportunity to maximize safety from nicks and cuts without sacrificing closeness of the shave to be achieved and without introducing undue difficulties and inefficiencies into the shaving process. Further, the edge guards are securely retained on the blade throughout the usable life of the sharpened edge 11.

The present embodiments are to be considered in all respects as illustrative and not restrictive, the scope of the invention being indicated by the appended claims rather than by the foregoing description, and all changes which come within the meaning and range of equivalency of the claims are therefore intended to be embraced therein. For instance, it will be understood that the pre-etch masking material and/or even the deposited guard material may be applied by silk-screening techniques which may be suited to use while the blades remain in strip form.

What is claimed is:

1. A razor blade having a sharpened edge, flanking surfaces on either side of said edge extending rearwardly therefrom, and a plurality of small guard elements fixedly deposited in guard seats recessed in said blade, said guard seats being located at spaced intervals along said edge and extending rearwardly from said edge in at least one said surface and serving to securely retain said elements, said guard elements extending upwardly from said guard seats to beyond at least one of said edge and said surfaces.

2. The razor blade of claim 1 wherein said guard elements extend upwardly beyond both said edge and said surfaces.

3. The razor blade of claim 1 wherein substantially the entire length of said guard elements is seated in and retained by said recessed guard seats.

4. The razor blade of claim 3 wherein said recessed guard seats extending rearwardly from said blade edge in a said surface thereof are all interconnected by a locking guard seat extending transversely thereof substantially parallel to the blade edge, said guard elements being also deposited in said locking guard seat.

5. The razor blade of claim 4 wherein said guard seats are etched into said blade, and said guard elements are electroplated deposits.

6. The razor blade of claim 5 wherein the width of said guard elements at and proximate said blade edge is less than about 0.0055 inch.

7. The method of forming guard elements on a razor blade having a sharpened edge and flanking surfaces adjacent thereto comprising the steps of:

removing surface portions of the blade at the blade edge and extending rearwardly therefrom in a predetermined pattern in spaced intervals along the edge, thereby to create guard seats recessed from the edge and the flanking surfaces; and fixedly depositing sufficient guard-forming material in said recessed guard seats such that the guard elements formed thereby extend upwardly from said guard seats to beyond at least one of said edge and said flanking surfaces.

8. The method of claim 7 wherein said blade guard elements are formed on said blades substantially only in said recessed guard seats thereby to enhance the permanence of said guard elements on said blades.

9. The method of claim 8 wherein sufficient guard-forming material is deposited in said guard seats such that said formed guard elements extend upwardly beyond both said edge and said flanking surfaces.

10. The method of claim 9 wherein said step of removing portions of the blade in a predetermined pattern comprises protectively coating most of said edge and said flanking surfaces and exposing the remaining portions thereof at said spaced intervals, and subjecting said edge and said flanking surfaces to an eroding medium, said eroding medium acting only on said exposed portions of said edge and said flanking surfaces.

11. The method of claim 10 wherein the protective coating is a photoresist material and the exposed portions at said spaced intervals are created by imprinting an image on said photoresist material in the form of said predetermined pattern, and selectively removing said photoresist material from said blade in the pattern of said printed image.

12. The method of claim 11 wherein said eroding medium comprises a fluid etchant.

13. The method of claim 12 wherein said step of depositing guard-forming material comprises electrochemically plating said recessed guard seats with said guard-forming material.

14. The method of claim 13 including the further step of removing said photoresistive coating from said edge and said flanking surfaces following said electrochemical plating.

15. A razor blade having a plurality of guard elements arrayed along its cutting edge and extending rearwardly from the edge in the flanking surfaces adjacent thereto in recessed guard seats, said guard seats and guard elements being formed in accordance with the method of claim 7.

* * * * *